US006958482B2

(12) United States Patent
Martinez et al.

(10) Patent No.: US 6,958,482 B2
(45) Date of Patent: Oct. 25, 2005

(54) FIXER OR INK DETECTION IN HARDCOPY APPARATUS

(75) Inventors: Oscar Martinez, Barcelona (ES); Jose Luis Valero, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 146 days.

(21) Appl. No.: 10/629,779

(22) Filed: Jul. 30, 2003

(65) Prior Publication Data

US 2004/0085381 A1 May 6, 2004

(30) Foreign Application Priority Data

Jul. 30, 2002 (GB) ..... 0217618.8

(51) Int. Cl.[7] ..... G01N 21/64
(52) U.S. Cl. ..... 250/461.1; 250/559.4
(58) Field of Search ..... 250/559.4, 559.44, 250/458.1, 461.1, 599.44; 347/9, 13

(56) References Cited

U.S. PATENT DOCUMENTS 6,028,320 A * 2/2000 Uhling ..... 250/559.44

* cited by examiner

*Primary Examiner*—David Porta
*Assistant Examiner*—Tony Ko
(74) *Attorney, Agent, or Firm*—Foley & Lardner LLP

(57) ABSTRACT

To check that nozzles of printheads 11–15 applying fixer or an ink to a print media 22 are operating correctly, the fixer or ink is applied to selected locations on a fluorescent print media which is then subjected to ultra-violet radiation; the reflectivities at these locations are detected in the visible spectrum and the information is analyzed using appropriate image processing algorithms. In an ink-jet printer, for example, applied fixer may be irradiated with ultra-violet light by a source 30 and applied inks may be irradiated with visible light, with a common detector in the visible light range being employed.

23 Claims, 3 Drawing Sheets

FIXER OR INK DETECTION IN HARDCOPY APPARATUS

The present invention relates to a method and an apparatus for the detection of fixer or ink in hardcopy apparatus, especially ink-jet printers. In such apparatus, fixer and/or ink is applied by a plurality of nozzles and it is desired to check that each nozzle is operating correctly. The invention relates in particular to the detection of fixer or ink which, when applied to a print media, is not readily optically detectable.

For coloured inks, which are readily optically detectable, the correct operation of the respective nozzles can be checked simply by printing an appropriate pattern of ink on a print media and optically examining the printed pattern. For inks which are not readily optically detectable, U.S. Pat. No. 5,980,016 discloses applying such an ink in a pattern above or below an area of another ink. The effect of bleeding between the two inks converts a fractional fill pattern into a more solid fill pattern and this is used to detect the previously undetectable ink. A disadvantage of this arrangement is that it has limited accuracy since it can detect the effect of groups of nozzles but not individual nozzles.

One known method of detecting fixer involves the incorporation into the fixer of a component which is detectable under infra-red radiation or under ultra-violet radiation. Infrared detection has the disadvantage of requiring a different type of detector from that used for the colour inks in the visible spectrum. Moreover, the infra-red or ultra-violet additives are expensive and reduce the quality of images produced with the use of the fixer; in particular said additives have the disadvantage of changing the visual aspect of the media where the fixer is present. For example, since ambient light and other light sources can include infra-red and ultra-violet components, the fluorescence effect causes the printed image to have a different colour balance under differing lighting conditions. Thus the presence of an additive which fluoresces under ultra-violet light can cause the printed image to have a blue tinge.

Certain aspects of the present invention seek to overcome or reduce one of more of the above disadvantages.

According to a first aspect of the present invention, there is provided a method of detecting the presence of fixer or ink on a print media, said media including a fluorescent substance, the method comprising the steps of:

(i) irradiating said media at least at a first wavelength causing said substance to fluoresce to produce radiation at least at a second wavelength different from said first wavelength;

(ii) detecting the reflectivity of a portion of said media at said second wavelength;

(iii) providing a reference reflectivity; and (iv) comparing said detected reflectivity with said reference reflectivity to detect whether fixer or ink is present at said portion of said media.

This has the advantage of allowing fixer or ink which is not normally optically detectable to be detected on print media incorporating a fluorescent substance, such as some matt coated or plain paper media.

Said irradiating step is preferably undertaken with ultra-violet light, preferably at a said first wavelength below 380 nm.

Said detecting step is preferably undertaken in the visible range, preferably at a said second wavelength between 410 nm and 470 nm and most preferably at around 440 nm.

Said providing step preferably comprises providing a reference reflectivity which corresponds to the absence of fixer or ink. Alternatively, the reference reflectivity provided may correspond to the presence of fixer or ink.

Said comparing step may involve the determination of whether the difference between said detected reflectivity and said reference reflectivity lies within a predetermined range of values.

According to a second aspect of the present invention, there is provided a method of detecting fixer or ink on a print media comprising applying the fixer or ink to selected locations on a fluorescent print media, irradiating said media at a first wavelength, and identifying said locations at which the fixer or ink has been applied by comparing reflectivities at a second wavelength at said locations where fixer or ink has been applied with reflectivities at said second wavelength at locations where fixer or ink has not been applied.

According to a third aspect of the present invention, there is provided an apparatus for detecting the presence of fixer or ink on a print media, said print media including a fluorescent substance, said apparatus comprising a source of electromagnetic radiation of at least a first wavelength causing said substance to fluoresce to produce radiation at least at a second wavelength different from said first wavelength, said source being arranged to direct said radiation at said media, a detector of radiation at said second wavelength, said detector being arranged to detect the intensity of radiation at said second wavelength reflected from a portion of said media, and a comparator connected to said detector, said comparator being arranged to compare said detected intensity with a reference intensity of reflected radiation.

The apparatus may be arranged to detect the presence of both fixer and ink at separate locations on a print media, said apparatus comprising first and second sources of electromagnetic wavelengths, said first source radiating at least at said first wavelength and said second source radiating at other wavelengths. Thus, the first source may radiate in the ultra-violet range and be used to detect the presence of fixer, and the second source may radiate in the visible range and be used to detect the presence of ink.

According to a fourth aspect of the present invention, there is provided an apparatus for detecting fixer or ink on a fluorescent print media comprising a printhead, said printhead being arranged to apply fixer or ink to selected locations on said media, a source of electromagnetic radiation for irradiating said print media at least at a first wavelength, and a detector for detecting the reflectivity at least at a second wavelength at selected portions of said print media.

The invention further comprises a hardcopy device incorporating the above apparatus and having a plurality of sets of nozzles for applying to print media indicia in a plurality of respective fluid media, at least one of which is not readily optically detectable on the print media, wherein a common irradiating means is used in respect of the indicia formed by all the fluid media and a common, or similar, detection means is used in respect of the indicia formed by all the fluid media.

The detection means may be a line scanner. Such a line scanner is already present in various types of hardcopy device.

According to a fifth aspect of the present invention, there is provided a hardcopy device comprising apparatus in accordance with either the third or the fourth aspect of the invention and comprising a fixer printhead including a plurality of nozzles for applying fixer to said print media in a selected pattern.

The hardcopy device may further comprise a controller, said controller being arranged:

(i) to cause said nozzles to apply fixer to a portion of said print media in said predetermined pattern;

(ii) to move said portion of said print media to a location adjacent said source and said detector;

(iii) to cause said source to irradiate said portion; and (iv) to cause said detector to detect the intensity of radiation reflected from said portion and to supply an output to said comparator.

The hardcopy device is preferably an ink-jet printer comprising one or more further printheads for one or more inks.

Said one or more further printheads, said source of electromagnetic radiation and said detector are all mounted on a movable carriage.

Said detector may be a line scanner.

As used herein, the term ink" includes coloured inks and also other liquids which are printed on print media, such as liquids including biological specimens.

A fixer is a liquid applied to print media to fix another liquid on the media, i.e. to restrict the spreading of the other liquid through the print media from the location where the other liquid is originally applied. Thus a fixer can be regarded as a substance which changes the properties of the print media. When applied, fixer alone should not be visible optically since this would adversely effect printing quality.

The expression "hardcopy device" embraces all types of apparatus which apply indicia to print media and embraces all types of printers, photocopiers, facsimile machines and scanners.

Preferred embodiments of the present invention will now be described, by way of example only, with reference to the accompanying drawings, of which:

Figure 1:
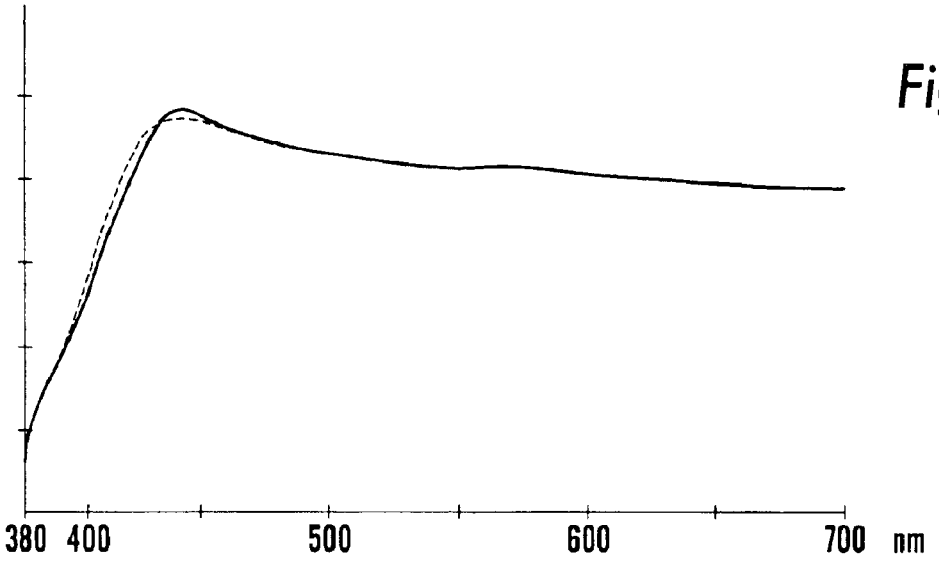
FIG. 1 shows a graph of reflectivity against wavelength for paper, illuminated with visible light.

Referring to the drawings, FIG. 1 shows the frequency response of the reflectivity or reflectance of paper when exposed to illumination in the frequency range from 380 nm to 780 nm. The paper actually used to prepare FIG. 1 is of the lustre glossy type. The frequency response of paper alone is shown by a broken line and the frequency response of paper with applied fixer is shown by a solid line. It will be noted that, throughout the measurement range of 380 nm to 780 nm the frequency responses are substantially the same and thus it is almost impossible to distinguish them visually.

Figure 2:
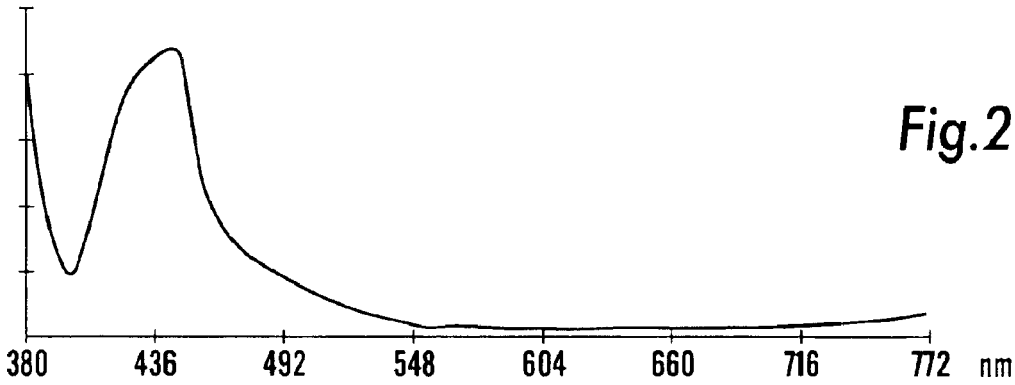
FIG. 2 shows a similar graph for glossy paper, illuminated with ultra-violet light.

For glossy paper under ultra-violet illumination with a wavelength below 380 nm, the frequency responses of the paper alone and the paper with applied fixer remain almost the same, as shown in FIG. 2. Thus the locations on the paper surface with and without fixer cannot be visually differentiated and this is why only a single line is visible in FIG. 2, said line representing both frequency responses.

Figure 3:
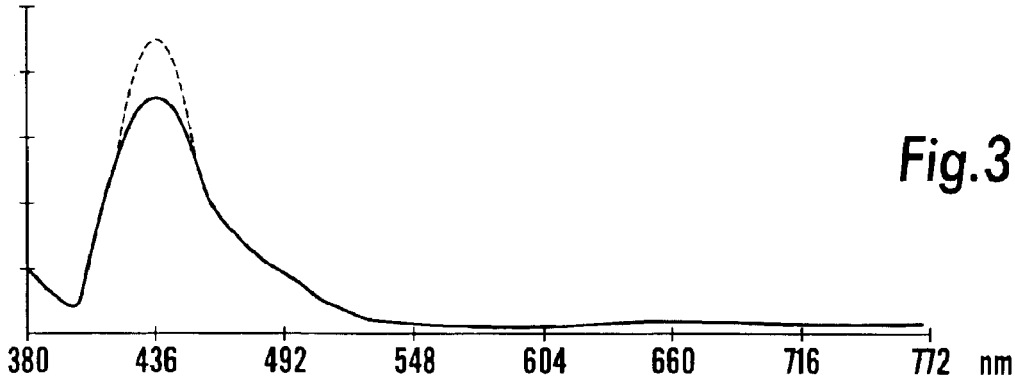
FIG. 3 is a similar graph for paper treated with a fluorescent material and illuminated with ultra-violet light exemplifying the method employed in embodiments of the present invention.

Referring now to FIG. 3, there is shown the relationship of reflectivity or reflectance against wavelength for a paper coated with a fluorescent material. Again, the frequency response of the paper alone is indicated by a broken line and the frequency response of the paper with applied fixer is indicated by a solid line. Under ultra-violet radiation at a wavelength below 380 nm there is a clear difference in the response at and around 440 nm, which corresponds to blue light. The fluorescence response of the media is detected by apparatus including a blue filter which eliminates unwanted signals at other wavelengths. The difference in responses is believed to be due to the fixer blocking, or at least attenuating, the passage of ultra-violet light to the media.

It will now be explained how the relationship described in connection with FIG. 3 can be used to check the health of each of a plurality of nozzles used to apply fixer in printers. Techniques are already known for checking that the ink nozzles of printers are all firing correctly by printing a predetermined image pattern and then using a scanner to optically detect the pattern and analysing the information with appropriate image-processing algorithms. Methods according to embodiments of the present invention overcome the problem of identifying the location of fixer drops applied to a print media; although these drops normally cannot be observed visually, they can be observed visually by irradiating them with a separate ultra-violet source. Since blue light is produced, similar radiation detecting means and the same image-processing algorithms can be used as for coloured inks under daylight or other visible illumination. Thus there is no need for additional expenditure on modified hardware or software.

Figure 4:
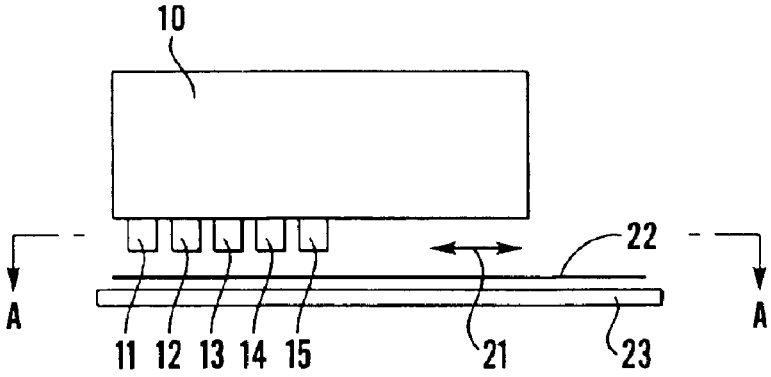
FIG. 4 is a side view of components of an ink-jet printer with a printhead carriage and as used in preferred embodiments of the present invention.
Figure 5:
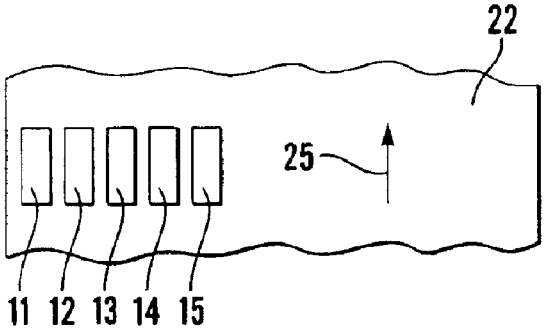
FIG. 5 is a top plan view of some of the components of the printer of FIG. 4.

FIG. 4 shows a side view of the printhead carriage 10 of an ink-jet printer indicated schematically at 20. FIG. 5 shows a top view of the line A—A of FIG. 4. The carriage 10 is caused to move forwards, and backwards in a scanning direction indicated by arrow 21 in FIG. 4 over a print media 22. Between scans by the carriage 10, the print media 22 is advanced over a fixed platen 23 of the printer in a media advance direction indicated by arrow 25 in FIG. 5. The carriage 10 carries five printheads 11,12,13,14,15 each comprising sets of nozzles respectively firing cyan, magenta, yellow and black inks and fixer liquid on to the print media during the scans of the carriage 10.

Figure 6:
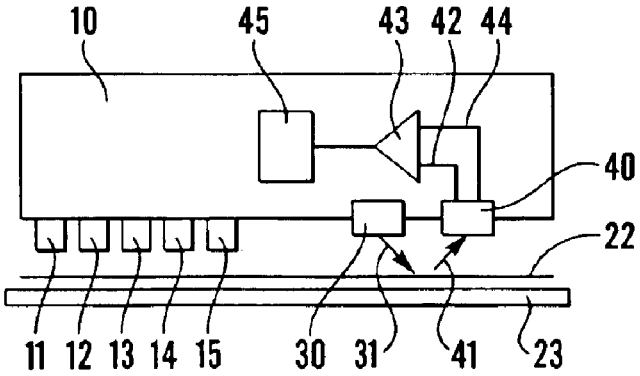
FIG. 6 is a schematic side view of an irradiation and detection arrangement used in a first embodiment of the present invention.

FIG. 6 shows a schematic side view similar to FIG. 4, but also including an ultra-violet radiation source 30 also mounted on carriage 10. Source 30 directs radiation 31 incorporating an ultra-violet component at the print media 22. A detector 40 of blue light 41 reflected from media 22 is also mounted on carriage 10.

To check that the nozzles of fixer printhead 15 are firing correctly, carriage 10 is caused to scan across print media 22 and to apply fixer thereto at a plurality of selected locations. The carriage 10 is caused to continue to move so that source 30 is positioned over and adjacent to the portion of media 22 with applied fixer. A first reflectivity signal 42 from detector 40 when it is detecting light 41 reflected from a location where it is known there is no applied fixer, is then directly compared by a comparator 43 with a second reflectivity signal 44 from detector 40 when it is detecting light 41 from a region where fixer has been applied. The reflectivity signals 40,42 may be generated simultaneously or one or both of them may be temporarily stored until the comparison has been effected. Comparator 43 supplies the result of the comparison to signal processing circuitry 45. Comparator 43 and circuitry 45 are both conveniently mounted on carriage 10.

The above-described arrangement has several further advantages. In particular, it provides a low-cost solution since no additives to the fixer are required. In addition, the properties of the inks used do not need to be changed. Moreover, there is no adverse effect on the quality of images produced by the printer. The above-described method can be used with a wide range of types of paper and other print media which are coated or otherwise treated with or incorporating one or more fluorescent materials. The method is particularly advantageous when used in connection with certain matt-coated and plain paper medias which are already coated with a fluorescent material in practice so that they have a perceived increase in whiteness. Thus for such media, no extra expense needs to be incurred in special preparation or treatment of the media.

The method is accurate and permits the checking of individual nozzles. The effects of individual defective nozzles can be hidden by adopting modified fixer application methods. Such methods employ algorithms similar to those known for normal ink nozzles to preserve acceptable print quality.

Another advantage is that the checking of the fixer application can be conducted completely independently of the checking of ink application. Accordingly, any imperfections in the ink nozzles do not need to be taken into account when checking the fixer nozzles, which simplifies the analysis.

Figure 7:
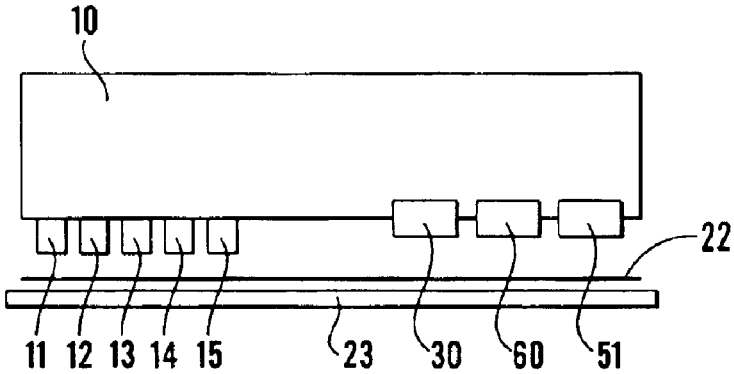
FIG. 7 is a schematic side view of a preferred type of irradiation arrangement used in embodiments of the present invention.

FIG. 7 shows a schematic side view of an irradiation arrangement comprising a suitable combination of radiation sources for enabling fixer application by printhead 15 to be detected at the same time as the application of inks from printheads 11 to 14. Here a source 51 of electromagnetic radiation in the visible range is located on carriage 10 adjacent ultra-violet source 30. When source 30 irradiates portions of print media 22 bearing fixer, blue light is reflected. When source 51 irradiates with visible light, portions of print media 22 bearing ink, the visible light is reflected. Because the radiation reflected from both fixer and ink are in the visible range, a common detector 60 can be used for checking correct operation of both the fixer nozzles of printhead 15 and the ink nozzles of printheads 11 to 14.

Figure 8:
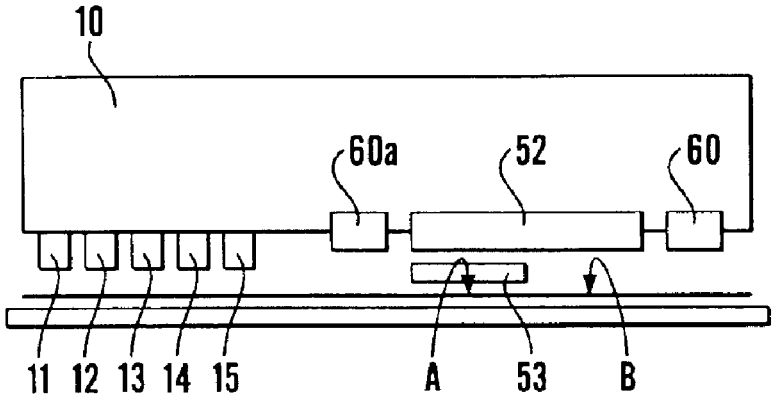
FIG. 8 is a schematic side view of an alternative type of irradiation arrangement to FIG. 7 and used in embodiments of the present invention.

FIG. 8 shows a schematic side view of an alternative irradiation arrangement for use in embodiments of the present invention. Here a single white light source 52 is provided which emits electromagnetic radiation in both the ultra-violet and visible ranges. A band-pass filter 53 which passes only radiation in the ultra-violet range is positioned between source 52 and a portion A of the print media 22. Thus substantially only ultra-violet radiation reaches portion A, to enable fixer to be detected there, and visible radiation reaches portion B, to enable ink to be detected there. Separate parts 60,60*a* of a detection arrangement may be used to detect the reflected radiation. Alternatively, means may be provided for selectively blocking the radiation from source 52 to either portion A and portion B so that fixer and inks are detected successively in time.

An advantage of the arrangement shown in FIG. 8 is that there is a saving in cost, since only a single light source 52 is required. In a modification, the ultra-violet filter 53 is omitted. This leads to a further cost saving, but there results a lower signal-to-noise ratio in the blue light reflected by the fixer, since unwanted radiation in the visible range is also present.

The actual electromagnetic wavelength or range of wavelengths used to detect the presence of fixer varies in dependence on the nature of the particular fluorescent material used and in particular the wavelength at which it fluoresces. For some applications, ambient daylight has a sufficient ultra-violet component and so this can be used instead of a light source being provided.

Figure 9:
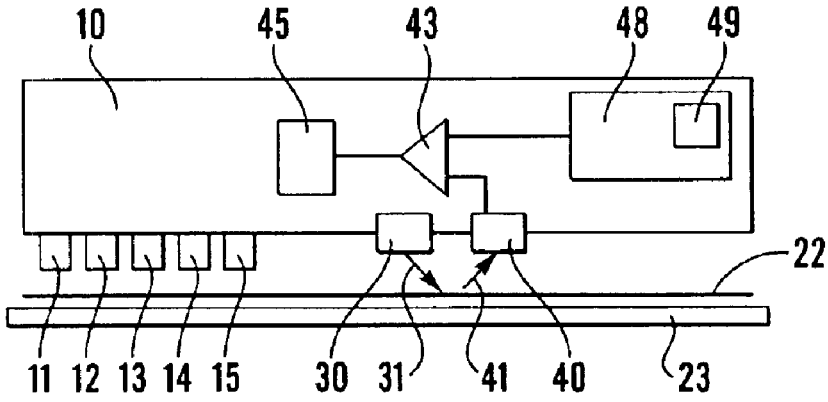
FIG. 9 is a schematic side view of an irradiation and detection arrangement used in a second embodiment of the present invention.

FIG. 9 is a schematic side view of an alternative arrangement to FIG. 6 for irradiation and detection. The arrangement comprises an ultra-violet source 30 and a blue light detector 40. In this arrangement the reflectivity corresponding to a location where there is no fixer is stored within the printer in a non-volatile memory 48 mounted on carriage 10.

In this case, the reflectivity determined by detector 40 is compared by comparator 43 with the permanently stored reflectivity in memory 48. To permit the use of different types of print media with the printer, different reflectivities corresponding to the different types of print media are stored in a non-volatile look-up table 49 within the memory 48 of the printer. In this case, means are provided for entering into the printer, either manually or automatically, the type of print media currently being used. The look-up table may also store values relating to different types of fixer. Whether the comparison process is direct or indirect, it may include the step of setting a threshold value for the difference between the reflectivities in order to determine whether or not fixer or ink is present. Depending upon whether the stored reflectivity represents presence or absence of fixer, the threshold is set correspondingly high or low.

In further arrangements, edge detection circuitry employing appropriate algorithms may be used to distinguish between regions where fixer has and has not been applied. In modifications some or all of the sources 30, 51, detectors 60,60*a*, comparator 43, circuitry 45 and memory 48 may be mounted on a fixed part of the printer rather than on movable carriage 10.

Instead of printhead 15, the fixer printhead may be printhead 11 or any of the intermediate printheads. The number of ink printheads may be any number from one upwards.

In addition to use in printers with a movable printhead carriage, methods in accordance with embodiments of the present invention are particularly applicable to page wide printers (so-called page wide array products) in which the printheads 11 to 15 are fixed relative to platen 23. Here the use of fixer is widespread to improve the durability of printed plots, and thus the cost of the fixer used must be kept as low as possible.

If a printing operation employing fixer is to be undertaken on a print media not incorporating a fluorescent substance (such as some types of glossy paper), the operation of the fixer nozzles can be previously checked on a separate piece of suitable media (such as matt coated paper) before feeding the desired print media to the printing zone. Thus the printer or other hardcopy apparatus may incorporate a separate media tray or media supply roller for supplying the media suitable for the present method.

Methods according to the invention may be used to check other print characteristics in addition to nozzle health, such as the alignment of the nozzles. The methods can be indirectly applied to monitor any property of the image quality of the printed plot affected by correct application of the fixer, such as ink feathering, bleed, text quality, area fill uniformity, coalescence and durability of the printed image.

Methods according to the invention have been found to work with all the different types of fixer tested. In addition to fixer, the method may be applied to an ink or other fluid which is not readily detectable by alternative methods, such as inks having "invisible" colours as discussed in U.S. Pat. No. 5,980,016, i.e. inks which are not readily optically detectable.

In certain circumstances it may not be necessary to detect the location of the fixer or ink. Thus it may simply be the presence of the fixer or ink which is detected. For example, this would be the case if it were required to check only that the fixer or ink nozzles were actually firing.

To achieve rationalisation of the detectors and software used to check the performance of all the nozzles in a printer, the method can be applied to all the inks, even those which could be easily detected by other methods. Thus instead of using the reflection of visible radiation directed at the print media to detect the presence of normal ink, the property of inks to absorb ultra-violet radiation can be used to detect the reflectivity in the visible range when ultra-violet radiation is directed at regions of the print media where ink has been deposited.

What is claimed is:

1. A method of detecting the presence of fixer or ink on a print media, said media including a fluorescent substance, said method comprising the steps of:

(i) irradiating said media at least at a first wavelength and causing said substance to fluoresce to produce radiation at least at a second wavelength different from said first wavelength;

(ii) detecting the emission of a portion of said media at said second wavelength;

(iii) providing a reference emission; and (iv) comparing said detected emission with said reference emission to detect whether fixer or ink is present at said portion of said media.

2. A method according to claim 1 wherein said irradiating step comprises irradiating said media with ultra-violet light.

3. A method according to claim 1, wherein said detecting step comprises detecting the emission in the visible light range.

4. A method according to claim 1, wherein said media is plain or matt paper.

5. A method according to claim 1, wherein said reference emission corresponds to the emission at said second wavelength of a different portion of said media without fixer or ink applied thereto.

6. A method according to claim 5 further comprising the further step of detecting the emission at said second wavelength of said different portion of said media without fixer or ink applied thereto and using this as said reference emission in said comparing step.

7. A method according to claim 5 further comprising the further step of storing the emission at said second wavelength corresponding to the absence of fixer or ink and using this as said reference emission in said comparing step.

8. A method of detecting fixer or ink on a print media comprising the steps of applying the fixer or ink to selected locations on a fluorescent print media, irradiating said media at a first wavelength; and identifying said locations at which the fixer or ink has been applied by comparing the emissions at a second wavelength at said locations where fixer or ink has been applied with emissions at said second wavelength at locations where fixer or ink has not been applied.

9. An apparatus for detecting the presence of fixer or ink on a print media, said print media including a fluorescent substance, said apparatus comprising a source of electromagnetic radiation of at least a first wavelength causing said substance to fluoresce and emit radiation at least at a second wavelength different from said first wavelength, said source being arranged to direct said radiation of at least a first wavelength at said media, a detector of radiation at said second wavelength, said detector being arranged to detect the intensity of radiation at said second wavelength emitted from a portion of said media, and a comparator connected to said detector, said comparator being arranged to compare said emitted intensity with a reference intensity of emitted radiation.

10. An apparatus according to claim 9, wherein said source radiates ultra-violet light.

11. An apparatus according to claim 10, wherein said detector detects visible light.

12. An apparatus according to claim 9, wherein said reference intensity corresponds to the absence of fixer or ink on said print media.

13. An apparatus according to claim 12, wherein said detector provides at least first and second outputs to respective first and second inputs of said comparator, said first detector output corresponding to a portion of said print media to be checked and said second detector output corresponding to a portion of said print media without fixer or ink.

14. An apparatus according to claim 12, wherein said detector provides an output to a first input of said comparator, the apparatus comprising a memory for storing an intensity value corresponding to the absence of fixer or ink on said print media, and said stored intensity value is provided to a second input of said comparator.

15. An apparatus according to claims 9, for detecting the presence of both fixer and ink at separate locations on a print media, said apparatus comprising first and second sources of electromagnetic wavelengths, said first source radiating at least at said first wavelength and said second source radiating at other wavelengths.

16. An apparatus according to claim 9, for detecting the presence of both fixer and ink at separate locations on a print media, said source of electromagnetic radiation radiating over a relatively wide range of wavelengths.

17. An apparatus according to claim 16, wherein an optical band pass filter is provided between a portion of said source and said print media.

18. An apparatus for detecting fixer or ink on a fluorescent print media comprising a printhead, said printhead being arranged to apply fixer or ink to selected locations on said media, a source of electromagnetic radiation for irradiating said print media at least at a first wavelength, and a detector for detecting the emission at least at a second wavelength at selected portions of said print media.

19. An apparatus for detecting fixer or ink on a fluorescent print media comprising means for printing said fixer or ink at selected locations on said media, means for irradiating said print media at least at a first electromagnetic wavelength, and means for detecting the emission at least at a second electromagnetic wavelength at selected portions of said print media.

20. A hardcopy device including an apparatus for detecting the presence of fixer on a print media, said print media including a fluorescent substance, said apparatus comprising a source of electromagnetic radiation of at least a first wavelength causing said substance to fluoresce to emit radiation at least at a second wavelength different from said first wavelength, said source being arranged to direct said radiation at said media, a detector of radiation at said second wavelength, said detector being arranged to detect the intensity of radiation at said second wavelength emitted from a portion of said media, and a comparator connected to said detector, said comparator being arranged to compare said detected intensity with a reference intensity of emitted radiation, said device further including a fixer printhead including a plurality of nozzles for applying fixer to said print media in a selected pattern.

21. A hardcopy device according to claim 20, further comprising a controller, said controller being arranged:

(i) to cause said nozzles to apply fixer to a portion of said print media in said predetermined pattern;

(ii) to move said portion of said print media to a location adjacent said source and said detector;

(iii) to cause said source to irradiate said portion; and (iv) to cause said detector to detect the intensity of radiation emitted from said portion and to supply an output to said comparator.

22. A hardcopy device according to claim 20, said hardcopy device being an ink-jet printer and comprising one or more further printheads for one or more inks.

23. A hardcopy device according to claim 22, wherein said fixer printhead, said one or more further printheads, said source of electromagnetic radiation and said detector are all mounted on a movable carriage.

* * * * *